US009810375B2

(12) United States Patent
Rider et al.

(10) Patent No.: US 9,810,375 B2
(45) Date of Patent: Nov. 7, 2017

(54) ENGAGEMENT OF GAS CYLINDER WITH GAS DISPENSER

(71) Applicant: Coravin, Inc., Burlington, MA (US)

(72) Inventors: Mike Rider, Lowell, MA (US); Andrew S. Sweezey, Somerville, MA (US)

(73) Assignee: Coravin, Inc., Burlington, MA (US)

( * ) Notice: Subject to any disclaimer, the term of this patent is extended or adjusted under 35 U.S.C. 154(b) by 220 days.

(21) Appl. No.: 14/755,050

(22) Filed: Jun. 30, 2015

(65) Prior Publication Data

US 2017/0002980 A1 Jan. 5, 2017

(51) Int. Cl.

| | |
|---|---|
| ***F17C 5/06*** | (2006.01) |
| ***B01F 3/04*** | (2006.01) |
| *B67D 1/04* | (2006.01) |

(52) U.S. Cl.

CPC ..... *F17C 5/06* (2013.01); *B01F 3/04794* (2013.01); *B67D 1/0418* (2013.01); *F17C 2201/058* (2013.01); *F17C 2205/0323* (2013.01); *F17C 2205/0338* (2013.01); *F17C 2270/01* (2013.01)

(58) Field of Classification Search

CPC .... B01F 3/04794; B01F 3/04801; B67B 7/08; B67D 1/0418

See application file for complete search history.

(56) References Cited

U.S. PATENT DOCUMENTS

| | | | | |
|---|---|---|---|---|
| 718,163 | A | 1/1903 | Sherrard | |
| 1,509,916 | A | 9/1924 | Waite | |
| 2,367,077 | A | 1/1945 | Ward | |
| 2,496,258 | A | 2/1950 | Alexander | |
| 2,705,578 | A | 4/1955 | Burns | |
| 2,805,846 | A * | 9/1957 | Dewan | B01F 3/04801 137/850 |
| 3,191,533 | A | 6/1965 | Vandenberg | |
| 3,200,094 | A | 8/1965 | Levinson | |
| 3,272,404 | A | 9/1966 | Graves | |

(Continued)

FOREIGN PATENT DOCUMENTS

| | | | |
|---|---|---|---|
| DE | 4009248 | A1 | 10/1991 |
| EP | 0258057 | A2 | 3/1988 |

(Continued)

OTHER PUBLICATIONS

International Search Report and Written Opinion of the International Searching Authority dated Sep. 16, 2016 from corresponding International Application No. PCT/US2016/040261.

(Continued)

*Primary Examiner* — Jason K Niesz

(74) *Attorney, Agent, or Firm* — Wolf, Greenfield & Sacks, P.C.

(57) ABSTRACT

Devices and methods for engaging a gas cylinder with a gas dispenser, such as a beverage extractor, an inflation device, or other system that uses pressurized gas. A resilient element may be used to force a gas cylinder into engagement with a piercing element to pierce an outlet of the gas cylinder. The resilient element may deform elastically and/or plastically when applying force to the cylinder to pierce the outlet and sealingly engage the cylinder with a receiver. The resilient element may compensate for cylinders having different sizes and/or provide a consistent piercing or sealing force.

22 Claims, 8 Drawing Sheets

(56) References Cited

U.S. PATENT DOCUMENTS

| | | | |
|---|---|---|---|
| 3,327,899 | A | 6/1967 | Reynolds |
| 3,542,240 | A | 11/1970 | Solowey |
| 3,883,043 | A | 5/1975 | Lane |
| 3,976,221 | A | 8/1976 | Martin |
| 4,011,971 | A | 3/1977 | Haydon |
| 4,143,678 | A | 3/1979 | Sugimura |
| 4,473,174 | A | 9/1984 | Heuser |
| 4,475,576 | A | 10/1984 | Simon |
| 4,595,121 | A | 6/1986 | Schultz |
| 4,674,662 | A | 6/1987 | Bergstrom |
| 4,691,482 | A | 9/1987 | Heinemann |
| 4,694,850 | A | 9/1987 | Fumino |
| 4,706,847 | A | 11/1987 | Sankey |
| 4,856,680 | A | 8/1989 | Sitton |
| 4,867,209 | A | 9/1989 | Santoiemmo |
| 4,932,561 | A | 6/1990 | Boxall |
| 4,953,741 | A | 9/1990 | Jessop |
| 4,976,984 | A | 12/1990 | Yasukawa |
| 4,982,879 | A | 1/1991 | Corrando |
| 4,984,711 | A | 1/1991 | Ellis |
| 5,020,395 | A | 6/1991 | Mackey |
| 5,031,799 | A | 7/1991 | Owen |
| 5,139,179 | A | 8/1992 | Cecil |
| 5,163,909 | A | 11/1992 | Stewart |
| 5,180,081 | A | 1/1993 | McCann |
| 5,395,012 | A | 3/1995 | Grill |
| 5,407,096 | A | 4/1995 | Smith |
| 5,413,230 | A | 5/1995 | Folter |
| 5,413,247 | A | 5/1995 | Glasa |
| 5,590,696 | A * | 1/1997 | Phillips ..... B60S 5/043 141/19 |
| 5,947,172 | A | 9/1999 | Glotin |
| 6,371,173 | B1 | 4/2002 | Liebmann, Jr. |
| 6,607,100 | B2 | 8/2003 | Phelps |
| 6,789,698 | B2 | 9/2004 | Gloor |
| 6,843,388 | B1 | 1/2005 | Hollars |
| 7,056,179 | B2 | 6/2006 | Courtney |
| 7,703,640 | B1 | 4/2010 | Hollars |
| 7,712,637 | B2 | 5/2010 | Lambrecht |
| 8,033,431 | B2 | 10/2011 | Sommerfield |
| 8,225,959 | B2 | 7/2012 | Lambrecht |
| 2010/0206390 | A1 | 8/2010 | Hollars |
| 2011/0016692 | A1 | 1/2011 | Hollars |
| 2012/0073674 | A1 | 3/2012 | Tatarek |

FOREIGN PATENT DOCUMENTS

| | | | |
|---|---|---|---|
| FR | 2257855 | A1 | 8/1975 |
| FR | 2507735 | A1 | 12/1982 |
| GB | 191008433 | A | 0/1910 |

OTHER PUBLICATIONS

International Search Report and Written Opinion dated Apr. 9, 2014 from corresponding PCT Application No. PCT/US2013/063814.

* cited by examiner

ENGAGEMENT OF GAS CYLINDER WITH GAS DISPENSER

BACKGROUND OF INVENTION

This invention relates generally to engaging a pressurized gas cylinder with a gas dispenser, such as a beverage extractor used in dispensing of wine from a wine bottle.

SUMMARY OF INVENTION

A wide range of devices employ pressurized gas cylinders, including beverage extractors like that described in U.S. Pat. No. 8,225,959, cork removers like that in U.S. Pat. No. 5,020,395, beverage carbonators like that in U.S. Pat. No. 4,867,209, medical fluid delivery systems as in U.S. Pat. No. 5,163,909, as well as others including tire inflation devices, pellet guns, etc. Gas cylinders are engaged with a receiver of these devices in different ways to deliver pressurized gas to the device. For example, in U.S. Pat. No. 5,020,395, the gas cylinder has a threaded neck that is screwed into a threaded hole of a receiver. In U.S. Pat. No. 4,867,209, the gas cylinder is placed in a cap which is threaded onto a body to engage the cylinder with a receiver. In U.S. Pat. No. 5,163,909, a lever operated toggle mechanism forces a cylinder held in a cradle into engagement with a receiver.

The inventors have appreciated that cylinder engagement approaches like those above can present difficulties in some circumstances. For example, some systems are not tolerant of cylinders that vary in size, e.g., in length and/or diameter, and may not properly seat a cylinder that is outside of an expected size range. In some systems, such as those where a user is required to turn a cylinder or cap to engage the cylinder with a receiver, users may not appreciate exactly how much to tighten the cylinder or cap, resulting in a loose, connection (which may leak) or overtightening (which may cause damage to seal and/or thread components).

One or more aspects of the invention allow a gas dispensing system to be tolerant of cylinder size variations while still providing for a suitable sealing engagement of the cylinder with a receiver. Moreover, one or more aspects of the invention may ensure proper tightening or other action to properly engage a cylinder with a receiver while minimizing the potential for creating a loose or over-tight connection. Yet other aspects of the invention may help avoid the attempt to reuse an empty or used cylinder.

In one illustrative embodiment that incorporates one or more aspects of the invention, a resilient element may be used to apply a force to a gas cylinder to engage the cylinder with a receiver of a gas dispensing device. Such engagement may involve piercing of a gas outlet of the cylinder and/or sealingly engaging the cylinder with the receiver (e.g., to resist leaking of gas in an unwanted way). By employing a resilient element to transmit an engagement force to the cylinder, the resilient element may deform as needed to accommodate differently sized and/or shaped cylinders while applying a relatively consistent engagement force to the different cylinders. For example, deformation of the resilient element may compensate for over-rotation of a cap in a device like that in U.S. Pat. No. 4,867,209. In fact, some embodiments may allow a user to thread a cap like that in U.S. Pat. No. 4,867,209 to a stop where no further threading of the cap is permitted, and yet ensure proper engagement of the cylinder even in the case of cylinders that are shorter or longer than standard.

In one aspect, a gas dispensing device is provided for dispensing pressurized gas contained in a sealed gas cylinder having a neck with a top surface and a side surface, where the top surface has a piercable gas outlet, and the gas cylinder has a bottom at an opposite end of the gas cylinder relative to the top surface. The dispensing device may include a body having a gas dispensing outlet, and a receiver attached to the body and arranged to sealingly engage with the neck of the gas cylinder to receive pressurized gas from the gas outlet and provide the gas to the gas dispensing outlet of the body. The receiver may include a piercing element arranged to pierce the gas outlet to release gas from the gas cylinder as the neck of the gas cylinder is forced into engagement with the receiver. A holder may be arranged to receive the gas cylinder and engage with the body so as to force the neck of a received gas cylinder into engagement with the receiver. A resilient element may be arranged for positioning between the holder and a received gas cylinder to transmit force from the holder to the gas cylinder as the holder is engaged with the body to force the neck of the received gas cylinder into engagement with the receiver. The resilient element may deform with force transmitted to the gas cylinder suitable to cause the piercing element to pierce the gas outlet.

In one embodiment, a rigid force transmitter may be positioned between the resilient element and the cylinder that provides a contact area between the force transmitter and the resilient element. The force transmitter may be arranged so that the contact area has a same size for different cylinders that have different sizes, shapes, etc. For example, the force transmitter may include a rigid, flat plate positioned on the resilient element and that contacts a bottom of a cylinder to transmit force of the holder to the cylinder.

In one embodiment, the holder may include a threaded portion arranged to engage with a threaded portion of the body, with the threaded portion of the holder being located near a top of the holder and the resilient element located near a bottom of the holder. For example, the holder may have a cup shape with an opening at the top of the holder and an interior space, and the resilient element may be located in the interior space near the bottom of the holder. The holder may be movable relative to the body to a stop which prevents further rotation of the holder relative to the body.

In some embodiments, the resilient element may be arranged to plastically deform with force transmitted to the gas cylinder suitable to cause the piercing element to pierce the gas outlet. Thus, the resilient element may be suitable only for a single use. In some embodiments, the resilient element may be attached to the bottom of the gas cylinder, and may include a piece of elastomeric material.

In some arrangements, the gas dispenser may include a regulator to regulate a pressure of gas delivered to the gas dispensing outlet and a valve to control flow of gas from the regulator to the gas dispensing outlet. For example, the dispenser may be part of a beverage extractor that has a needle attached to the body and in fluid communication with the gas dispensing outlet. The needle may have a lumen and be arranged to be inserted through a cork of a wine bottle so as to deliver pressurized gas from the gas dispensing outlet to an interior of the bottle. The needle may additionally be arranged to conduct a flow of wine through the needle to a wine outlet of the body, and the body may include a valve arranged to control flow of wine from the needle to the wine outlet.

In some embodiments, the gas dispensing device need not include a cylinder holder, and instead may include any suitable type of cylinder drive arranged to move the gas cylinder and the receiver toward each other so as to force the neck of the gas cylinder into engagement with the receiver. For example, the cylinder drive may include a linkage, a toggle, hydraulic or pneumatic piston, motor drive, screw, etc., and the resilient element may be arranged to transmit force of the cylinder drive to the gas cylinder to force the neck of the received gas cylinder into engagement with the receiver.

In another aspect, a method of dispensing pressurized gas contained in a sealed gas cylinder includes moving a resilient element toward a bottom of the gas cylinder so as to deform the resilient element and move the gas outlet of the gas cylinder into engagement with a piercing element to pierce the gas outlet. The neck of the gas cylinder may be sealingly engaged with a receiver that receives pressurized gas from the pierced gas outlet, and the pressurized gas may be dispensed from the cylinder at a gas dispensing outlet of a gas dispenser. In some embodiments, the steps of moving and sealingly engaging comprise threading a holder holding the gas cylinder and the resilient element onto a body to which the receiver is attached.

One or more embodiments in accordance with aspects of the invention allow a user to withdraw or otherwise extract a beverage, such as wine, from within a bottle that is sealed by a cork, plug, elastomeric septum or other closure without removing the closure. In some cases, removal of liquid from such a bottle may be performed one or more times, yet the closure may remain in place during and after each beverage extraction to maintain a seal for the bottle. Thus, the beverage may be dispensed from the bottle multiple times and stored for extended periods between each extraction with little or no effect on beverage quality. In some embodiments, little or no gas, such as air, which is reactive with the beverage may be introduced into the bottle either during or after extraction of beverage from within the bottle. Thus, in some embodiments, a user may withdraw wine from a wine bottle without removal of, or damage to, the cork, and without allowing air or other potentially damaging gasses or liquids entry into the bottle.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Aspects of the invention are described below with reference to illustrative embodiments, but it should be understood that aspects of the invention are not to be construed narrowly in view of the specific embodiments described. Thus, aspects of the invention are not limited to the embodiments described herein. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

Figure 1:
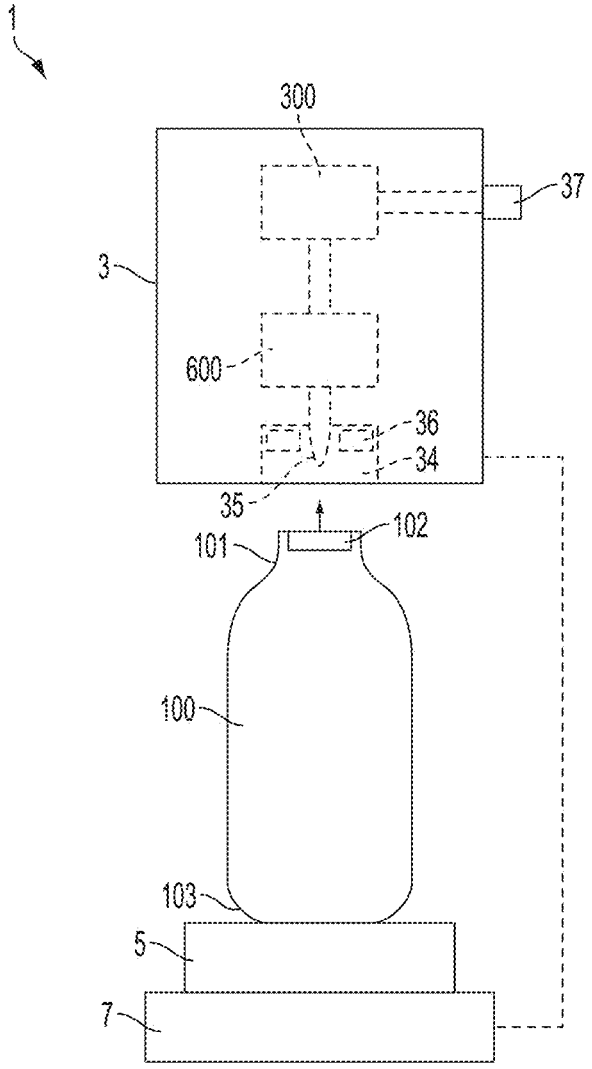
FIG. 1 shows a schematic diagram of a gas delivery system in an illustrative embodiment.

FIG. 1 shows a schematic diagram of a gas delivery device 1 that incorporates one or more aspects of the invention. In this illustrative embodiment, the gas delivery device 1 includes a body 3 that has a gas dispensing outlet 37, which may take a variety of different forms depending on the purpose of the gas delivery device 1. For example, if the device 1 is intended to inflate tires, the gas dispensing outlet 37 may be arranged to couple with a tire valve stem to deliver pressurized gas to the tire. In another embodiment, the device 1 may be arranged to pressurize the inside of a cork-stoppered bottle to remove the cork. In this case, a needle (not shown) may be attached at the gas dispensing outlet 37 so that gas can be delivered to an internal lumen of the needle. The needle may be inserted through the bottle cork so gas is delivered via the needle lumen to the bottle interior to expel the cork. Other gas delivery devices are possible, such as for use in pellet guns, medical fluid delivery devices, beverage carbonation devices, etc. Thus, the dispensing outlet 37 need not necessarily be exposed at an exterior of the device 1, but rather may lead to other components of the device, such as a needle, valve, conduit, reservoir, etc.

In this embodiment, the device 1 includes a receiver 34 attached to the body 3 that is arranged to couple with a gas cylinder 100 to receive gas from the cylinder 100. In this example, the receiver 34 includes a piercing element 35 arranged to pierce a gas outlet 102 of the cylinder 100 as the neck 101 of the cylinder 100 is moved toward the receiver 34. That is, as the neck 101 of the cylinder 100 is moved into an opening of the receiver 34, the piercing element 35 may penetrate the gas outlet 102, which may be a metal cap that seals the cylinder closed, containing relatively high pressure gas, e.g., 3000 psi or less. A gasket 36 may be used to create a gas-tight seal between the neck 101 and the receiver 34, e.g., so that gas does not leak from the cylinder 100 in an unwanted way. When properly mated with the receiver 34, the cylinder 100 may deliver pressurized gas to a passageway through or near the piercing element 35. Although in this embodiment the piercing element 35 and gasket 36 are shown assembled with the receiver 34, either or both of the piercing element 35 and the gasket 36 may be assembled with the cylinder 100, or be separate components from both the receiver 34 and the cylinder 100. Also, while the receiver 34 in this embodiment has an opening that receives the neck 101 of the cylinder 100, such an arrangement is not necessary. Instead, the receiver 34 may be arranged at a flat surface or protrusion of the body 3, for example.

The gas dispensing device 1 is also shown as including a regulator 600 that is fluidly coupled to the receiver 34 via a passageway or conduit to receive pressurized gas from the gas cylinder 100. The regulator 600 may have one or more stages, or otherwise include suitable components, such as one or more valves, to adjust a pressure of gas to a desired range. Of course, the regulator 600 is optional and may be eliminated since pressure regulation of gas from the cylinder 100 is not required in all aspects. The device 1 also is shown with a valve 300 that can control the flow of gas from the receiver 34 to the dispensing outlet 37. Again, the valve 300 is optional, but if included may include any suitable structure or components, such as a valve ball element, gate, spool or other valve structure. Other elements may be included as well, such as a filter to filter gas delivered to the outlet 37, a safety valve to release gas over a certain pressure in the passageway leading from the receiver 34 to the dispensing outlet 37, a pressure sensor, a moisture separator, etc.

In accordance with an aspect of the invention, the device 1 includes a cylinder drive 7 arranged to move the gas cylinder 100 and the receiver 34 towards each other so as to mate the cylinder with the receiver. Although referred to as a "cylinder" drive, the drive 7 may operate in any suitable way to move the cylinder 100 and receiver 34 toward each other so that gas released by the cylinder 100 is received by the receiver 34. In the illustrative embodiment of FIG. 1, the cylinder drive 7 includes a dashed line element coupled between the body 3 and a portion of the drive 7 positioned below a bottom 103 of the cylinder. The dashed line element is intended to schematically represent a mechanism or component arranged to move the cylinder 100 and the receiver 34 toward each other, such as a mechanical linkage, a motor drive, a threaded engagement, a magnetic coupling, a clamp, etc.

In accordance with an aspect of the invention, force applied by the cylinder drive 7 to move the cylinder 100 and the receiver 34 toward each other is transmitted via a resilient element 5. In this illustrative embodiment, the resilient element 5 contacts a bottom 103 of the cylinder 100, but the resilient element 5 could contact the cylinder 100 in other areas to transmit a motive force, e.g., at the cylinder sides, neck 101 or other portion. Alternately, the resilient element 5 may be arranged to transmit a motive force to the receiver 34, e.g., the resilient element 5 may be positioned between the body 3 and the receiver 34, or may be arranged between portions of the cylinder drive 7, e.g., as a link in a drive linkage. As described above, the resilient element 5 may allow the device 1 to be more tolerant of size and/or shape variations in gas cylinders 100, e.g., in diameter and/or length. For example, although standard gas cylinders 100 may be approximately the same length from the gas outlet 102 to the bottom 103, cylinders do vary in length because of manufacturing tolerances and other reasons. By being functionally arranged between the cylinder drive 7 and the cylinder 100 (or receiver 34), the resilient element 5 may accommodate variations in size, shape or other characteristic of cylinders 100. For example, the resilient element 5 may be arranged to deform when applying force to the cylinder 100 when mating the cylinder 100 with the receiver 34. As a result, differences in cylinder length, diameter or other size, or shape (e.g., of the bottom 103) may be compensated for by deformation of the resilient element 5. In one embodiment, the resilient element 5 may include a spring or elastomeric material arranged so that for cylinders longer than a standard, the resilient element 5 will deform more than usual to compensate for the longer length while still applying a suitable force to cause the cylinder 100 to be properly mated with the receiver 34. On the other hand, cylinders that are shorter than the standard may be compensated for because, while the resilient element 5 may deform less than with a relatively long cylinder, the resilient element 5 may still deform even when operating with a "short" cylinder, ensuring that appropriate mating force is applied to the receiver 34 and cylinder 100. Those of skill will appreciate that other variations in cylinder size or shape may be accommodated, such as differences in the size or shape of the bottom 103 of cylinders 100. As a result, for example, the embodiment shown in FIG. 1 may be able to accommodate very different cylinder configurations, such as cylinders with a hemispherical bottom as shown, as well as cylinders with a flat bottom, cylinders with a rectangular tube shape, etc.

In accordance with another aspect of the invention, the resilient element 5 may allow for a cylinder drive 7 to be moved to a stop or other defined point in its motion while applying a suitable engagement force to the receiver 34 and cylinder 100. This feature may be useful since a user may be assured that the cylinder and receiver are properly engaged by simply operating the cylinder drive 7 to a stop or other defined point. For example, the toggle mechanism in U.S. Pat. No. 5,163,909 may work with cylinders having a specific length, but may not operate properly at all if the cylinder is too short, too long, or has other variations in size or shape. In contrast, a toggle mechanism like that in U.S. Pat. No. 5,163,909 that is equipped with a resilient element in accordance with an aspect of the invention may be able to properly engage cylinders of a wider range of different sizes and/or shapes than otherwise possible. Moreover, a user can be ensured that proper engagement of the cylinder with the receiver is achieved by simply fully closing the toggle mechanism.

Figure 2:
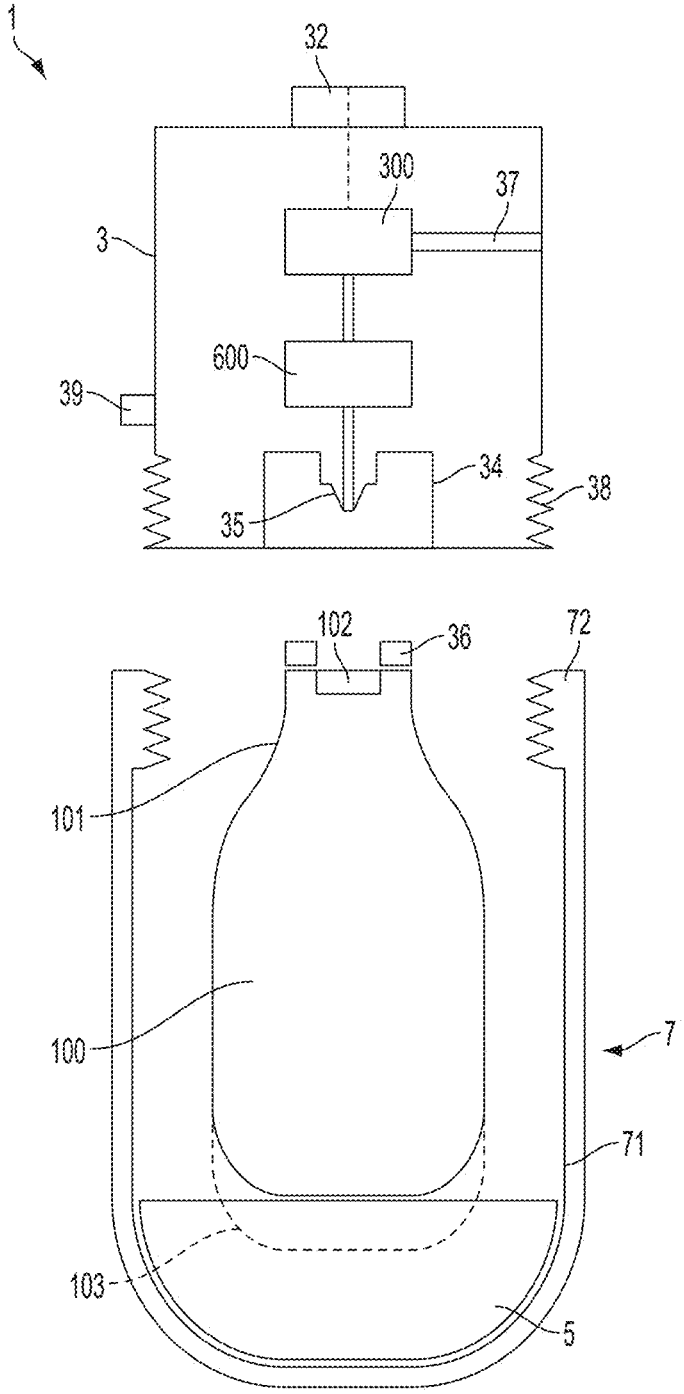
FIG. 2 shows a schematic diagram of a gas delivery system including a holder threadedly engaged with a system body to engage a gas cylinder with a receiver.
Figure 3:
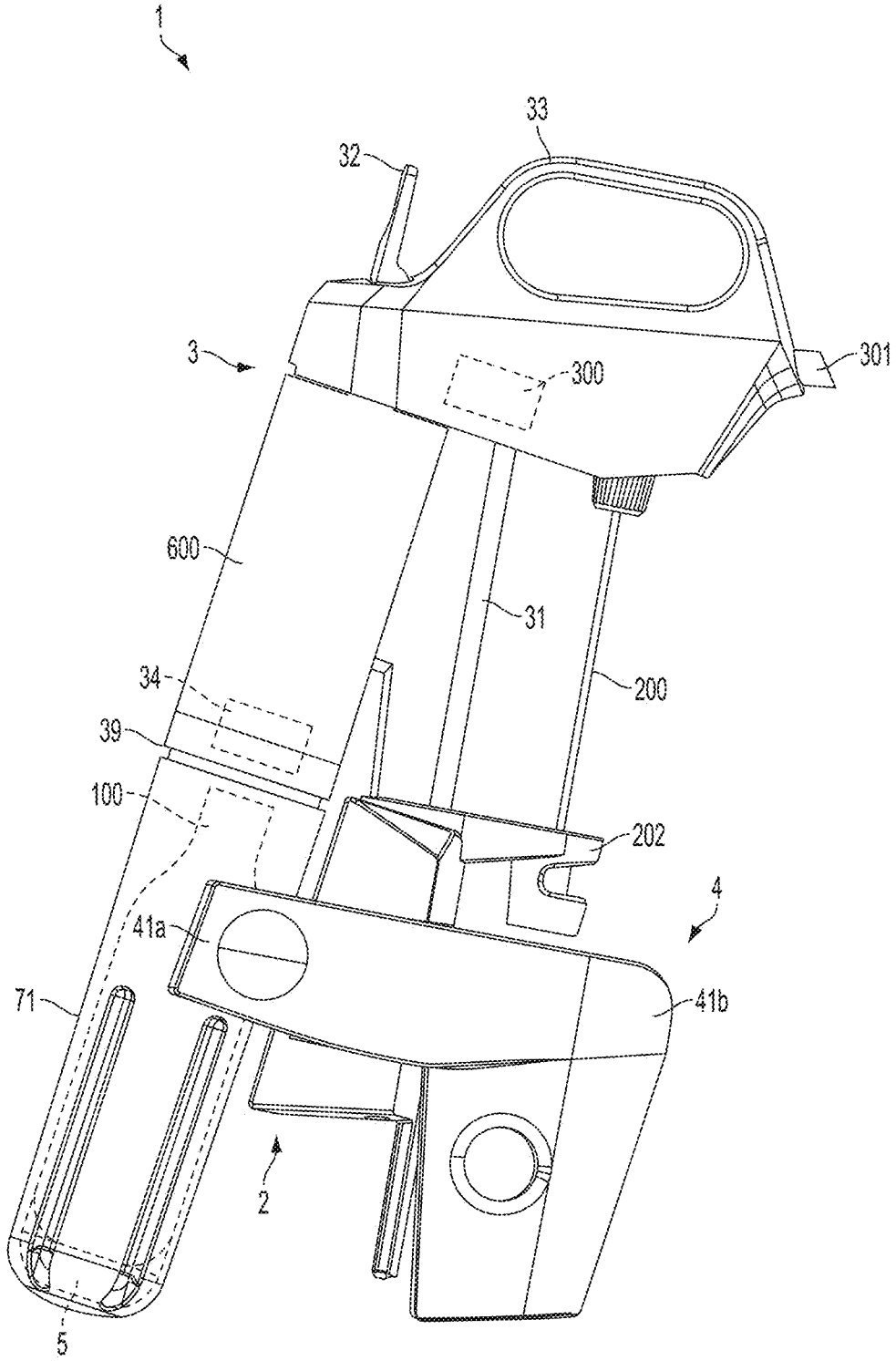
FIG. 3 shows a side view of a beverage extraction device in an illustrative embodiment.

The resilient element 5 can allow for other types of cylinder drive 7 arrangements to be operated to a stop or other defined point while ensuring proper engagement of the cylinder 100 with a receiver 34. For example, FIG. 2 shows an illustrative embodiment in which the cylinder drive 7 includes a holder 71 in the form of a cup-shaped cover. The holder 71 has an internal space that receives the cylinder 100 inserted through an opening near a top of the holder 71. The holder 71 also includes a threaded portion 72 near the top that is arranged to engage with a corresponding threaded portion 38 on the body 3. Thus, by threading the holder 71 onto the body 3, the cylinder 100 and receiver 34 may be moved toward each other. A resilient element 5 may be positioned at a bottom of the interior space of the holder 71 so as to contact the bottom 103 of the cylinder 100. As will be understood, as the holder 71 is threaded onto the body 3, the resilient element 5 moves the cylinder 100 upwardly so the cylinder neck 101 is received into an opening of the receiver 34, e.g., so that a piercing element 35 penetrates the gas outlet 102 of the cylinder to release gas. Also in this embodiment, a gasket 36, such as an o-ring or other seal, is carried on the cylinder 100 and is arranged to create a suitable seal between the receiver 34 and the cylinder 100.

In accordance with an aspect of the invention, the holder 71 may be threaded onto the body 3 until the holder 71 contacts a stop 39 on the body 3 that prevents further threading of the holder 71 onto the body 3. The stop 39 and resilient element 5 may be arranged so that when the holder 71 reaches the stop 39, cylinders 100 within a relatively wide range of sizes and/or shapes are suitably engaged with the receiver 34, e.g., so the piercing element 35 pierces the gas outlet 102 and the gasket 36 forms a suitable, leak-resistant seal. (Of course, piercing of the gas outlet 102 is not required, e.g., the cylinder may have a valve at the gas outlet 102 that is opened as the cylinder is mated with the receiver so gas is released without piercing.) In this illustrative embodiment, the resilient element 5 may deform so that a bottom 103 of the cylinder 100 is received into the resilient element 5 as shown in dashed line in FIG. 2. As a result, a user may be ensured of proper cylinder/receiver engagement by simply threading the holder 71 onto the body 3 until the stop 39 is reached. Of course, other stop arrangements are possible, such as a stop on the holder 71 that contacts a portion of the body 3, the threads on the body 3 and/or holder 71 may terminate so as to function as a stop, a marking on the body and/or holder may indicate a point at which engagement of the holder with the body should be terminated, etc. It should also be understood that the holder 71 is not limited to engaging the body 3 with a thread, but instead may engage via a bayonet connection, a cam connection, a clamp, etc.

While in the illustrative embodiment of FIG. 2 the resilient element 5 is shown located at a bottom of the interior space of the holder 71 such that a cylinder 100 inserted into the holder 71 rests on the resilient element 5, other arrangements are possible. For example, a resilient element 5 may be attached to the bottom 103 of each cylinder 100 so that once the cylinder 100 is placed in a holder 71 like that in FIG. 2, the resilient element 5 is positioned to transmit force to the cylinder as the holder 71 is engaged with the body 3. The resilient element 5 may be removably attached to the cylinder 100, e.g., so that the resilient element 5 can be removed from a used cylinder and placed on a new one, or permanently attached to the cylinder, e.g., so that the resilient element is not usable with another cylinder if removed from a used cylinder. In the case of permanent attachment of the resilient element 5 to a cylinder 100, the use of a new resilient element 5 with each cylinder may help ensure that proper force is applied to engage the cylinder with the receiver 34, especially if the resilient element 5 deforms plastically during use. In some embodiments, the resilient element 5 may deform elastically, plastically, or both elastically and plastically when a cylinder 100 is engaged with a receiver 34. A resilient element 5 that deforms completely or mostly elastically may allow for repeated use of the resilient element 5 with different cylinders. On the other hand, a resilient element 5 that deforms completely or mostly plastically may permit only one-time use of the resilient element 5. In some embodiments, the resilient element 5 may be arranged to crush or otherwise deform plastically so as to make the element 5 effectively unusable with another cylinder.

Another feature shown in FIG. 2 is an actuator 32 that may be operated by a user to control operation of the valve 300. The actuator 32 may include, for example, a push button or lever that a user can move to open and/or close the valve 300. Of course, the actuator 32 may be operated in other ways, such as by an electromechanical device (such as a solenoid or motor), a pressure sensitive switch, etc. The actuator 32 may be used to control gas flow, or for other purposes, such as regulating a gas pressure, causing a piercing element to pierce a cylinder engaged with the receiver, and other functions. Thus, the cylinder drive 7 may function to simply sealingly engage a cylinder with a receiver, and need not cause gas to be released from a cylinder upon engagement.

FIGS. 3-9 show an illustrative embodiment of a beverage extraction device 1 that incorporates aspects of the invention. As described in U.S. Pat. No. 8,225,959, such a device may be used to extract wine from a wine bottle without removing a cork that seals an opening of the bottle closed. In this embodiment, the extractor 1 includes a body 3 with a handle 33, that may be gripped by a user for moving the body 3 relative to the base 2 in upward and downward motions to insert a needle 200 through a cork or other closure of a bottle (not shown). To allow movement of the body 3 relative to the base 2, e.g., for insertion of the needle 200 through a cork, the body 3 includes a rail 31 that has T-shaped cross section, and is arranged to move within a T-shaped receiving slot or channel 21 of the base 2. However, other arrangements are possible for engaging the body 3 and base 2 while allowing for movement of the needle 200. With the needle 200 inserted through a cork, gas can be injected into the bottle to force wine to exit the bottle. A lever 32 is provided for operating a valve 300, e.g., to deliver gas to the bottle via the needle 200 so that beverage can be dispensed from an outlet 301.

Figure 4:
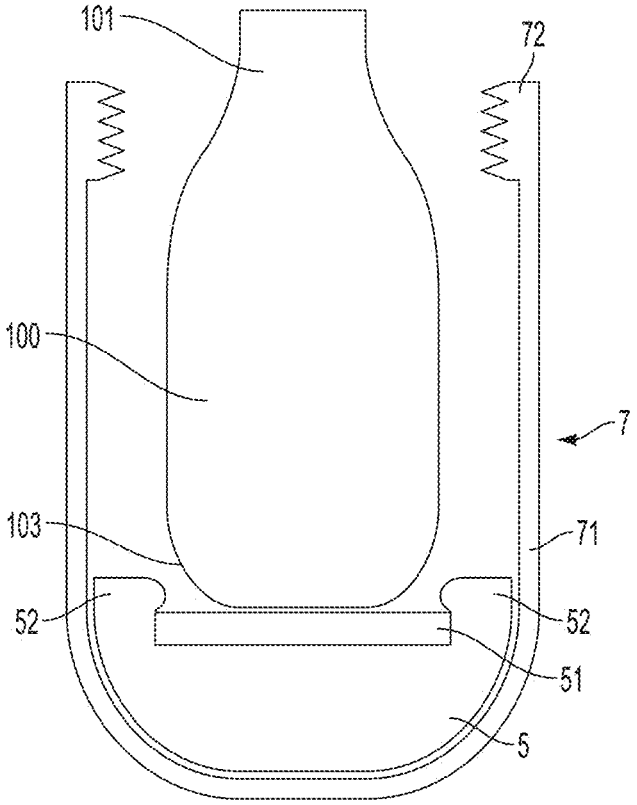
FIG. 4 shows a cross sectional view of the holder of the extraction device of FIG. 3.
Figure 5:
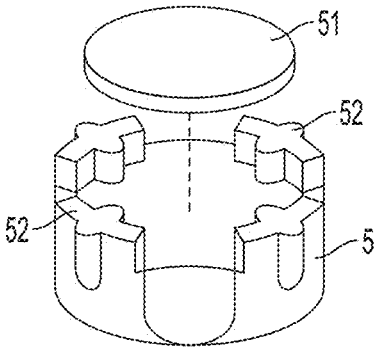
FIG. 5 shows a perspective view of the resilient element used with the holder of the extraction device of FIG. 3.
Figure 6:
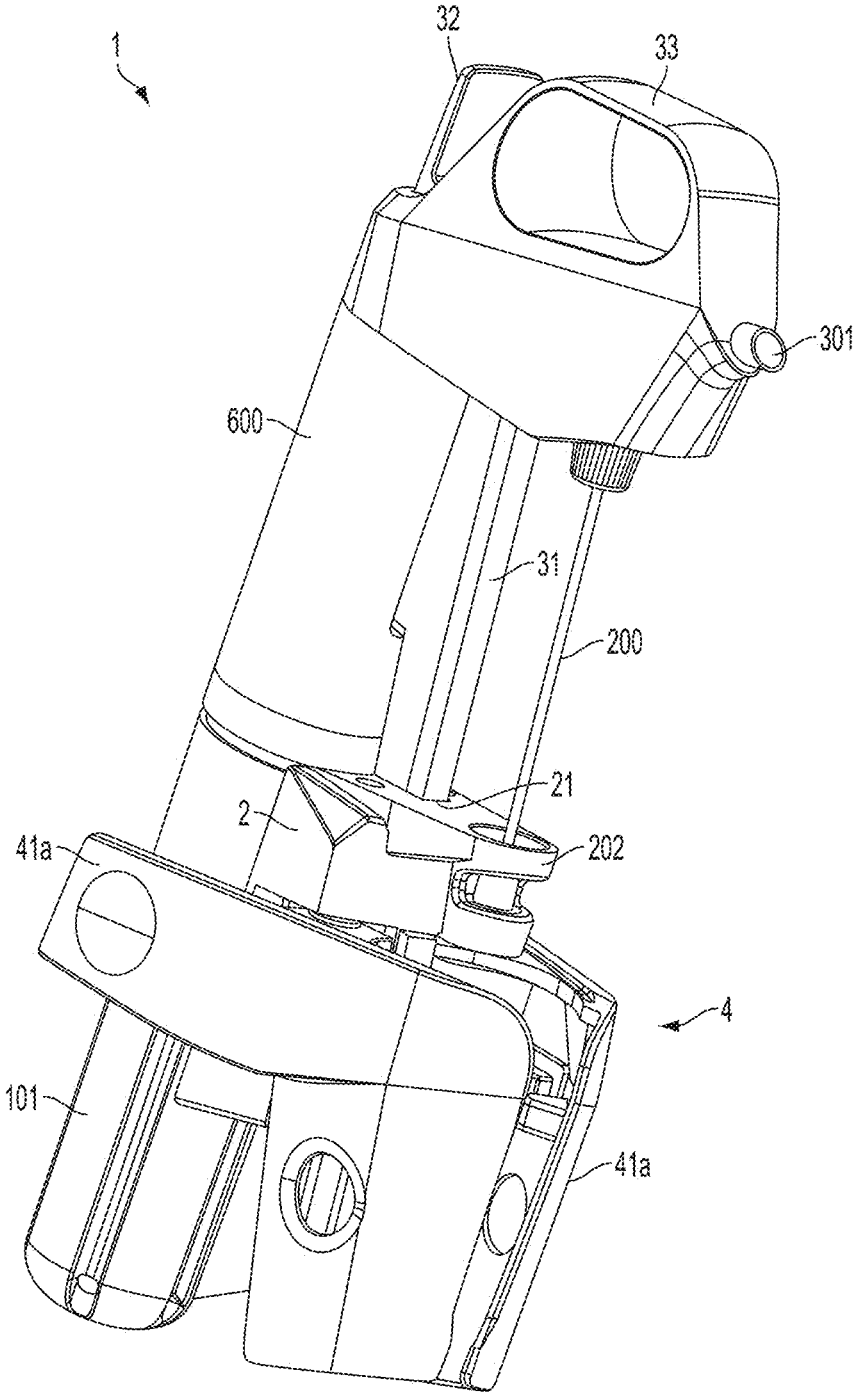
FIG. 6 shows a perspective front view of the extraction device of FIG. 3.

In accordance with an aspect of the invention, the device 1 includes a gas cylinder 100 held by a holder 71 arranged as shown in FIGS. 4 and 5. The resilient element 5 is arranged similarly to that in FIG. 2, e.g., in the form of a block of elastomeric material having a durometer of about 50-100 on the Shore A scale is located in the holder 71 near a bottom of an interior space of the holder 71, but in this embodiment includes a metal or other non-resilient force transmitter 51 between the cylinder 100 and the resilient element 5. As can be seen in FIG. 5, the force transmitter 51 may be arranged as a flat, solid disc, but may have other shapes, such as a washer or annular shape in which the bottom 103 of the cylinder is at least partially received in the center of the annulus, a bowl shape with a concave portion that receives a portion of the cylinder bottom 103, a solid plate having an irregular, polygonal or other shape, and others. A non-resilient force transmitter 51 may help engage a cylinder 100 with a receiver 34 in configurations like that in FIGS. 2 and 4. For example, where the holder 71 and resilient element 5 are rotated to engage a cylinder 100 with a receiver 34, the cylinder may not itself rotate upon initiating engagement with the receiver 34 (e.g., due to friction or mechanical coupling). As a result, the resilient element 5 may rotate relative to the cylinder bottom 103, and friction between the cylinder 100 and the resilient element 5 may make rotation of the holder 71 more difficult, especially as the force between the resilient element 5 and the cylinder 100 increases. By providing a non-resilient force transmitter 51, friction between the resilient element 5 and the cylinder 100 may be reduced, making rotation of the holder 71 easier. For example, the force transmitter 51 may be made of a metal or other material that has a reduced coefficient of friction in relation to the resilient material of the element 5. Alternately, or in addition, the force transmitter 51 may be rigid and arranged to contact a relatively small portion of the cylinder 100, thereby further reducing frictional forces. For example, the force transmitter 51 may be a rigid plate arranged to contact a point or other small area of the cylinder 100 near or at an axis of rotation of the resilient element 5, thereby reducing frictional forces between the cylinder 100 and the resilient element 5. Other arrangements are possible, including a ball or needle bearing arrangement between the cylinder 100 and the resilient element 5, a lubricant, etc.

A force transmitter 51 may also aid in properly engaging a cylinder 100 with a receiver 34 by providing a known contact area with the resilient element 5 to which force is applied. For example, cylinders 100 with a larger surface area at the bottom 103 will tend to apply force to the resilient element 5 over a larger area than cylinders 100 with a smaller surface area at the bottom 103. This difference in contact surface area may result in different forces being applied to the cylinders for a same displacement of the resilient element 5 relative to the cylinder. This could be a problem, either by applying too little engagement force to cylinders with a small surface area, or too much engagement force for cylinders with a larger surface area. In contrast, a force transmitter 51 may provide a known and consistent contact surface area between the cylinder 100/force transmitter 51 and the resilient element 5 regardless of the shape, size or other configuration of the cylinder bottom 103.

In this embodiment, the resilient element 5 includes one or more retainers 52 that help engage and/or position the force transmitter 51 with respect to the resilient element 5. In this embodiment, the retainers 52 are arranged as hooks that respectively engage a portion of the transmitter 51 and hold the transmitter 51 in place. However, other arrangements are possible for a retainer, such as an adhesive, fasteners, welding, heat staking, etc., and the retainer(s) may allow the transmitter 51 to be removed from the resilient element 5 or provide a permanent attachment. Alternately, the force transmitter 51 need not be attached to the resilient element 5.

To engage the cylinder 100 with the receiver, the holder 71 in this embodiment threadedly engages with the body 3 near the regulator 600. The resilient element 5 and the holder 71 are arranged so that a cylinder 100 is properly engaged with the receiver 34 when the holder 71 is threaded onto the body 3 so that a top edge of the holder 71 contacts a stop 39 on the body 3, e.g., such that any gap between the holder 71 and the body 3 is completely closed. As a result, a user can be assured that the cylinder 100 is properly seated with respect to the receiver 34 if the holder 71 is completely screwed onto the body 3.

In some embodiments, a suitable gas pressure is introduced into a beverage bottle to extract beverage from the bottle. For example, with some wine bottles, it has been found that a maximum pressure of between around 40 and 50 psi may be introduced into the bottle without risking leakage at, or ejection of, the cork, although pressures of between around 15 and 30 psi have been found to work well. These pressures are well tolerated by even the weakest of cork-to-bottle seals at the bottle opening without causing cork dislodging or passage of liquid or gas by the cork, and provide for relatively fast beverage extraction. The lower pressure limit in the bottle during wine extraction for some embodiments has been found to be between about 0 and 20 psi. That is, a pressure between about 0 and 20 psi has been found needed in a bottle to provide a suitably fast extraction of beverage from the bottle. In one example using a single 17 to 20 gauge needle, a pressure of 30 psi was used to establish an initial pressure in a wine bottle, and rapid wine extraction was experienced even as the internal pressure dropped to about 15-20 psi.

The source of pressurized gas can be any of a variety of regulated or unregulated pressurized gas bottles filled with any of a variety of non-reactive gasses. In a preferred embodiment, the gas cylinder contains gas at an initial pressure of about 2000-3000 psi. This pressure has been found to allow the use of a single relatively small compressed gas cylinder (e.g., about 3 inches in length and 0.75 inches in diameter) for the complete extraction of the contents of several bottles of wine. Multiple gasses have been tested successfully over extended storage periods, and preferably the gas used is non-reactive with the beverage within the bottle, such as wine, and can serve to protect the beverage oxidation or other damage. Suitable gases include nitrogen, carbon dioxide, argon, helium, neon and others. Mixtures of gas are also possible. For example, a mixture of argon and another lighter gas could blanket wine or other beverage in argon while the lighter gas could occupy volume within the bottle and perhaps reduce the overall cost of the gas.

The beverage extraction device 1 may include a clamp 4 configured to engage the device with a bottle, e.g., by clamping the device to the neck of a bottle. For example, the device can include one or more clamp arms that are movably mounted to the device and are arranged to engage with a bottle to support the device on the bottle during use. The embodiment of FIGS. 3-9 has a clamp 4 with a pair of clamp arms 41, but it should be appreciated that a single clamp arm may be provided instead of a pair.

Figure 7:
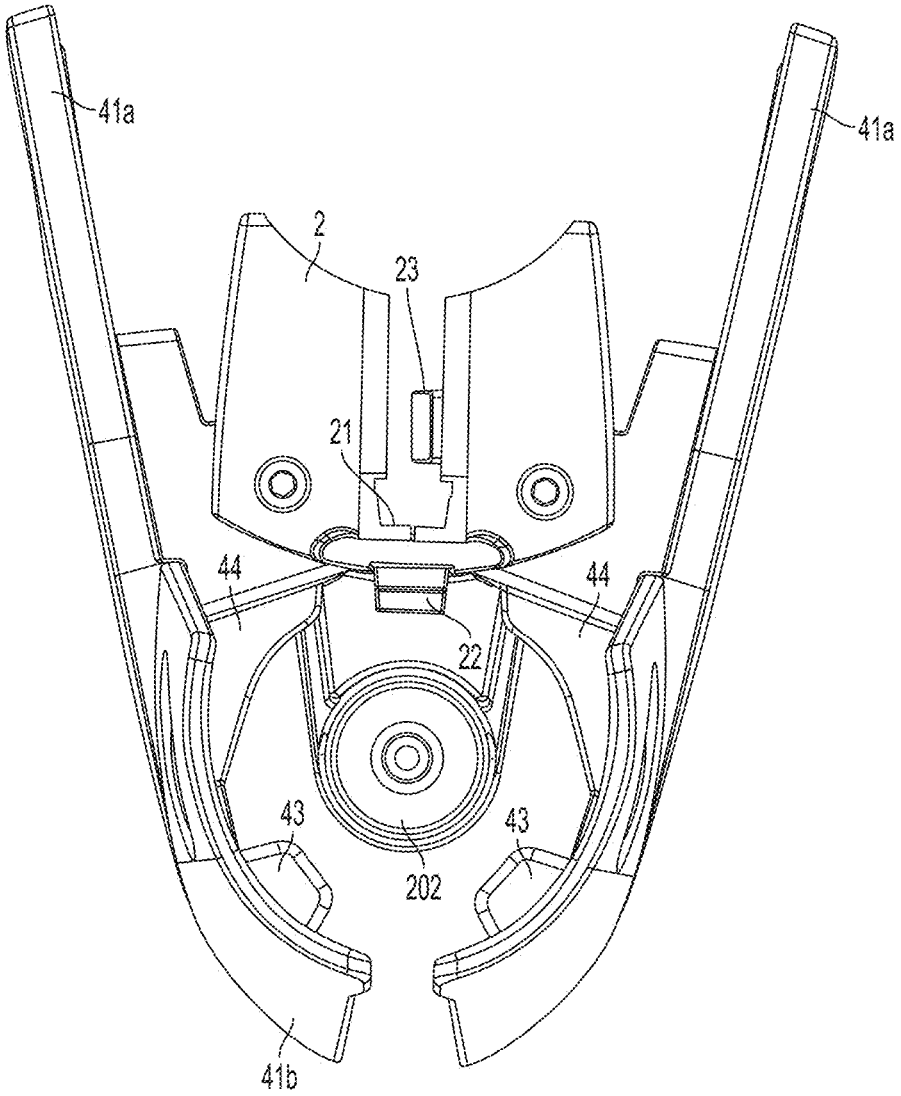
FIG. 7 shows a bottom view of the extraction device of FIG. 3.
Figure 8:
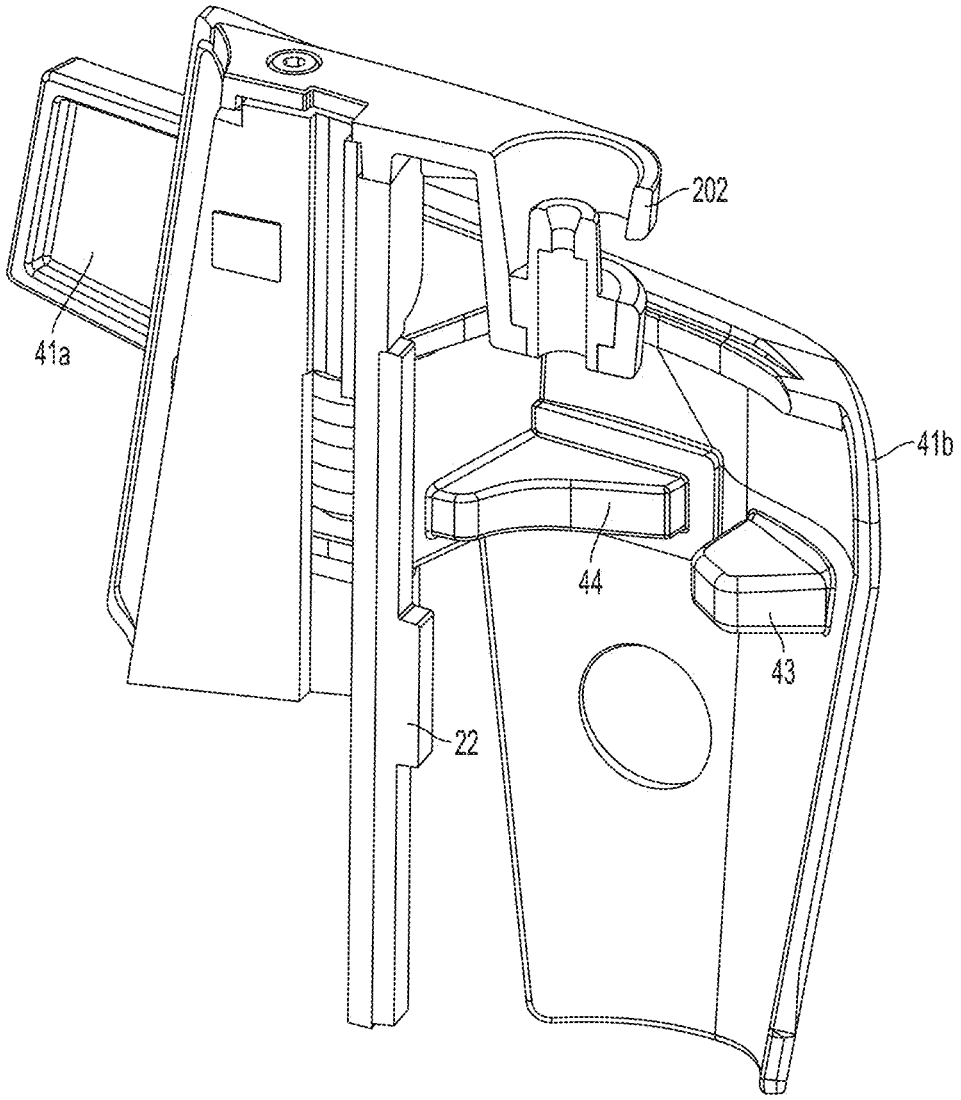
FIG. 8 shows a side view of an inner surface of a clamp arm of the FIG. 3 embodiment.
Figure 9:
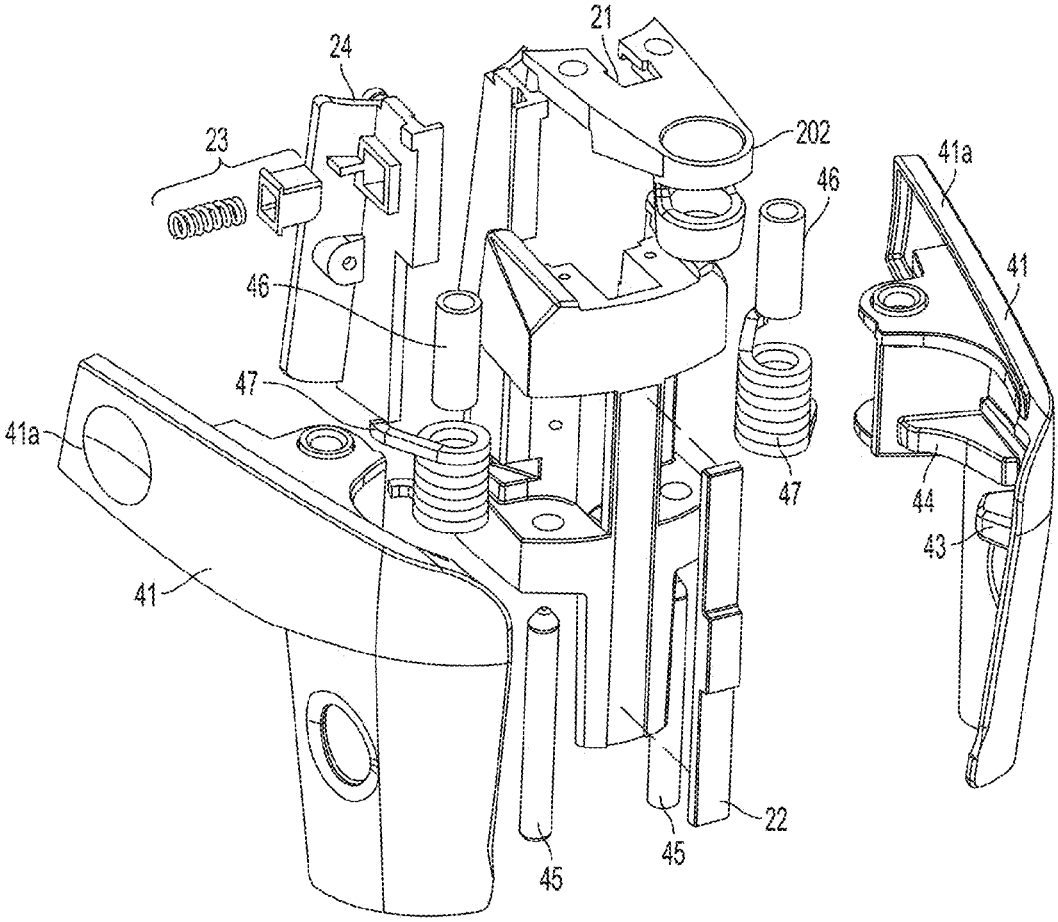
FIG. 9 shows an exploded view of the base in the FIG. 3 embodiment.

The clamp arm(s) may include a feature to help properly engage the clamp arm(s) with a variety of different bottle necks. For example, different bottles may have different neck diameters, different lip diameters or lengths (as used herein, a lip is a feature of many wine bottles near the top of the neck in which the bottle flares, steps or otherwise protrudes outwardly in size). In one embodiment, the clamp arm(s) include a distal tab feature and a proximal ridge feature that cooperate to properly engage with different neck configurations. FIGS. 7-9 show one illustrative embodiment in which each clamp arm 41 includes a distal tab 43 and a proximal ridge 44. The tab 43 may extend radially inwardly somewhat more than the ridge 44, and thus help to center the bottle neck or otherwise appropriately position the neck relative to the clamp arms 41. For example, as the clamp arms 41 are closed on a neck, the tabs 43 may contact the neck before the ridges 44, helping to center or otherwise appropriately position the neck relative to the device 1. In some embodiments, the tabs 43 and/or the ridges 44 may have portions that contact the bottle neck have a relatively hard, low-friction surface to help allow the clamp arms 41 engage the neck while allowing the neck to shift in position relative to the clamp arms 41. The tabs 43 may help urge the neck proximally relative to the base 2, e.g., to move the neck toward a pad 22 located on the base 2 between the clamp arms 41. By urging the neck to move proximally and into contact with the pad 22 or other component, the clamp arms 41 may help position the neck in a consistent way relative to the needle guide 202 and the needle 200. This may help ensure that the needle 200 penetrates a bottle cork in a desired location. For example, the needle guide 202 and needle 200 may be arranged to pierce a cork in a location that is offset from a center of the cork with the neck positioned in contact with the pad 22. This may help avoid having the needle 200 penetrate the closure in the same location if the device 1 is used two or more times to extract beverage from the bottle. Alternately, the needle 200 and guide 202 may be configured to penetrate a cork at its center with the neck in contact with the pad 22.

The ridge 44, though optional, may have a length measured in a direction perpendicular to a bottle neck (or in a direction perpendicular to the length of the needle 200) that is greater than the tab 43, e.g., to help the ridge 43 provide a suitably long contact surface for the lip of the bottle. For example, while the tabs 43 may help center the neck between the clamp arms 41 and urge the neck to move proximally, the ridges 43 may contact an underside of the bottle lip with a suitably long surface to help prevent the neck from moving downwardly relative to the clamp arms 41 more than a desired distance. The extended length of the ridges 44 may provide the ridges 44 with greater strength and help the clamp arms operate with a wide array of bottle neck and lip sizes and shapes. In addition, the ridges 44 may have a variable radial length, e.g., increasing proximally as shown in FIG. 7, to help ensure that the ridges 44 will provide suitable engagement with a variety of different necks having different lip dimensions.

In this embodiment, the device 1 includes a detent that resiliently holds the body 3 in an upper position relative to the base 2, e.g., to help ensure that the body 3 does not move relative to the base 2 while at rest on a counter top. For example, the detent may include a spring-loaded ball or other element mounted on the base 2 that engages with a suitable groove on the body 3 to hold the body 3 and base 2 stationary relative to each other until suitable force is exerted to overcome the detent holding function. (See, for example, FIG. 9 which shows a detent 23 that includes a spring loaded plunger mounted to the base 2 that is arranged to engage with a groove or other feature on the rail 31 of the body 3.) Other detent arrangements are possible, such as a spring-loaded tab and slot, and others as will be appreciated by those of skill in the art. Moreover, a detent is not required to releasably hold the body 3 and base 2 in one or more positions relative to each other. For example, a friction element (such as a rubber strip positioned between the rail 31 and channel 21) may be included to provide a friction force that maintains the body and base stationary in the absence of a force over a threshold level. The friction element may provide the friction force for specific body/base positions, or throughout the full range of body/base movement. Other configurations are possible to help hold the body 3 and base 2 in one or more positions relative to each other, such as a spring-loaded pin, latch or other lock, a thumbscrew on the base 2 that can be tightened to engage the rail 31 and prevent body/base movement, etc.

In this illustrative embodiment, the clamp arms 41 are pivotally mounted to the base 2 such that the distal portions 41*b* are normally biased to move toward each other, e.g., to clamp a bottle neck positioned between the arms 41. For example, as shown in FIG. 9, the clamp arms 41 are mounted to the base 2 via pivot pins 45 and bushings 46. However, the clamp arms 41 may be movably mounted relative to the base 2 in other ways, such as by a linkage, living hinge, a sliding engagement (such as by having a portion of a clamp arm move in a channel of the base), and others. Also, one arm may be fixed to the base while the other is made movable (although in this embodiment the arms are still said to be moveable relative to each other). Torsion or other springs may be used to provide the biasing force (if provided at all) on the clamp arms 41. For example, in this embodiment, torsion springs 47 are mounted over the bushings 46 and are arranged to engage the base 2 and a clamp arm 41 so that the clamp arms are biased to move the distal portions 41*b* toward each other. This clamping force of the clamp arms 41 may be sufficiently robust to support the device 1 on the bottle, or even to allow a user to lift and pour beverage from the bottle by grasping and manipulating the device 1. The clamp arms 41 may also include proximal portions 41*a* that can be grasped by a user and moved together (overcoming the biasing force of the springs 47) so that the distal portions 41*b* are moved away from each other to receive a bottle neck. For example, in this embodiment, a user may pinch the proximal portions 41*a* together to position a bottle neck between the distal portions 41*b*, and then release the proximal portions 41*a* to allow the clamp arms 41 to clamp the bottle neck. However, other arrangements are possible. For example, the distal portions 41*b* may instead be biased to move away from each other and move toward each other when a user applies suitable force, e.g., to the distal portions 41*b*, to overcome the biasing force. In another embodiment, the clamp arms 41 need not be spring biased at all. In such arrangements where the clamp arms 41 are biased to move the distal portions 41*b* apart or are not biased at all, a locking mechanism may be used to engage the clamp arms 41 to the bottle.

The embodiment above, a single needle with a single lumen is used to introduce gas into the bottle and extract beverage from the bottle. However, in other embodiments two or more needles may be used, e.g., one needle for gas delivery and one needle for beverage extraction. In such an embodiment, the valve 300 may operate to simultaneously open a flow of gas to the bottle and open a flow of beverage from the bottle. The needles may have the same or different diameters or the same or different length varying from 0.25 to 10 inches. For example, one needle delivering gas could be longer than another that extracts wine from the bottle. Alternately, a two lumen needle may be employed where gas travels in one lumen and beverage travels in the other. Each lumen could have a separate entrance and exit, and the exits could be spaced from each other within the bottle to prevent circulation of gas.

While aspects of the invention have been shown and described with reference to illustrative embodiments, it will be understood by those skilled in the art that various changes in form and details may be made therein without departing from the scope of the invention encompassed by the appended claims.

The invention claimed is:

1. A gas dispensing device for dispensing pressurized gas contained in a sealed gas cylinder having a neck with a top surface and a side surface, the top surface having a piercable gas outlet, the gas cylinder further having a bottom at an opposite end of the gas cylinder relative to the top surface, the device comprising:

a body having a gas dispensing outlet;

a receiver attached to the body and arranged to sealingly engage with the neck of the gas cylinder to receive pressurized gas from the gas outlet and provide the gas to the gas dispensing outlet of the body, the receiver including a piercing element arranged to pierce the gas outlet to release gas from the gas cylinder as the neck of the gas cylinder is forced into engagement with the receiver;

a holder arranged to receive the gas cylinder and arranged to engage with the body so as to force the neck of a received gas cylinder into engagement with the receiver; and a resilient element arranged for positioning between the holder and a received gas cylinder to transmit force from the holder to the gas cylinder as the holder is engaged with the body to force the neck of the received gas cylinder into engagement with the receiver, the resilient element arranged to deform with force transmitted to the gas cylinder suitable to cause the piercing element to pierce the gas outlet, wherein the resilient element is arranged to both elastically and plastically deform with force transmitted to the gas cylinder suitable to cause the piercing element to pierce the gas outlet.

2. The device of claim 1, further comprising a rigid force transmitter between the resilient element and the cylinder that provides a contact area between the force transmitter and the resilient element.

3. The device of claim 2, wherein the holder includes a threaded portion arranged to engage with a threaded portion of the body, the threaded portion of the holder being located near a top of the holder, and the resilient element is located near a bottom of the holder.

4. The device of claim 3, wherein the holder has a cup shape with an opening at the top of the holder and an interior space, and wherein the resilient element is located in the interior space near the bottom of the holder and is arranged to contact the bottom of the gas cylinder.

5. The device of claim 1, wherein the holder is threadedly engaged to the body such that the holder is rotatable relative to the body to a stop which prevents further rotation of the holder relative to the body.

6. The device of claim 1, further comprising the gas cylinder.

7. The device of claim 6, wherein the resilient element is attached to the bottom of the gas cylinder.

8. The device of claim 1, wherein the resilient element is a piece of elastomeric material.

9. The device of claim 1, wherein the body includes a regulator to regulate a pressure of gas delivered to the gas dispensing outlet and a valve to control flow of gas from the regulator to the gas dispensing outlet.

10. The device of claim 9, further comprising a needle attached to the body and in fluid communication with the gas dispensing outlet, the needle having a lumen and arranged to be inserted through a cork of a wine bottle so as to deliver pressurized gas from the gas dispensing outlet to an interior of the bottle.

11. The device of claim 9, wherein the needle is arranged to conduct a flow of wine through the needle to a wine outlet of the body, the body including a valve arranged to control flow of wine from the needle to the wine outlet.

12. A gas dispensing device for dispensing pressurized gas contained in a sealed gas cylinder having a neck with a top surface and a side surface, the top surface having a piercable gas outlet, the gas cylinder further having a bottom at an opposite end of the gas cylinder relative to the top surface, the device comprising:

a receiver arranged to sealingly engage with the neck of the gas cylinder to receive pressurized gas from the gas outlet and provide the gas to a gas dispensing outlet;

a piercing element arranged to pierce the gas outlet to release gas from the gas cylinder as the neck of the gas cylinder is forced into engagement with the receiver;

a cylinder drive arranged to move the gas cylinder and the receiver toward each other so as to force the neck of the gas cylinder into engagement with the receiver; and a resilient element arranged to transmit force of the cylinder drive to the gas cylinder to force the neck of the received gas cylinder into engagement with the receiver, the resilient element arranged to deform with force transmitted to the gas cylinder suitable to cause the piercing element to pierce the gas outlet, wherein the resilient element is arranged to both elastically and plastically deform with force transmitted to the gas cylinder suitable to cause the piercing element to pierce the gas outlet.

13. The device of claim 12, wherein the receiver is attached to a body having a threaded portion, and wherein the cylinder drive includes a threaded portion arranged to engage with the threaded portion of the body to move the resilient element and the gas cylinder toward the receiver.

14. The device of claim 13, wherein the cylinder drive includes a cylinder holder including the threaded portion of the cylinder drive and arranged to hold the gas cylinder, and wherein the resilient element is located on the cylinder holder to contact the bottom of the gas cylinder.

15. The device of claim 14, wherein the cylinder holder includes a cup with an interior space to hold the gas cylinder, the cup having a top with an opening through which the gas cylinder is inserted into the interior space, wherein the threaded portion of the cylinder drive is located near a top of the cup, and the resilient element is located near a bottom of the interior space.

16. The device of claim 12, further comprising the gas cylinder.

17. The device of claim 16, wherein the resilient element is attached to the bottom of the gas cylinder.

18. The device of claim 12, wherein the resilient element is a piece of elastomeric material.

19. The device of claim 12, wherein the cylinder drive includes a stop that prevents movement of the cylinder drive beyond a stop point relative to the receiver.

20. The device of claim 12, further comprising a rigid force transmitter between the resilient element and the cylinder that provides a contact area between the force transmitter and the resilient element.

21. A method of dispensing pressurized gas contained in a sealed gas cylinder having a neck with a top surface and a side surface, the top surface having a piercable gas outlet, the gas cylinder further having a bottom at an opposite end of the gas cylinder relative to the top surface, the method comprising:

moving a resilient element toward a bottom of the gas cylinder so as to deform the resilient element both elastically and plastically and move the gas outlet of the gas cylinder into engagement with a piercing element to pierce the gas outlet;

sealingly engaging the neck of the gas cylinder with a receiver that receives pressurized gas from the pierced gas outlet; and dispensing the pressurized gas from the cylinder at a gas dispensing outlet of a gas dispenser.

22. The method of claim 21, wherein the steps of moving and sealingly engaging comprise threading a holder holding the gas cylinder and the resilient element onto a body to which the receiver is attached.

* * * * *